US009115562B2

(12) United States Patent
Guidry et al.

(10) Patent No.: US 9,115,562 B2
(45) Date of Patent: Aug. 25, 2015

(54) BALL LAUNCHER

(71) Applicant: Cameron International Corporation, Houston, TX (US)

(72) Inventors: Kirk P. Guidry, Cypress, TX (US); Michael F. Levert, Jr., Suager Land, TX (US); Kyle A. Sommerfeld, Houston, TX (US)

(73) Assignee: Cameron International Corporation, Houston, TX (US)

( * ) Notice: Subject to any disclaimer, the term of this patent is extended or adjusted under 35 U.S.C. 154(b) by 134 days.

(21) Appl. No.: 13/931,402

(22) Filed: Jun. 28, 2013

(65) Prior Publication Data

US 2015/0000901 A1 Jan. 1, 2015

(51) Int. Cl.
*E21B 33/068* (2006.01)
*E21B 43/26* (2006.01)

(52) U.S. Cl.
CPC ..... *E21B 33/068* (2013.01); *E21B 43/26* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,630,181 | A | 3/1953 | Solum | |
| 2,961,046 | A * | 11/1960 | Moeller et al. | 166/75.15 |
| 3,023,809 | A | 3/1962 | McClintock | |
| 4,425,083 | A | 1/1984 | Peterson et al. | |
| 6,409,843 | B1 * | 6/2002 | Ellett | 134/8 |
| 7,281,589 | B2 * | 10/2007 | Robichaux et al. | 166/386 |
| 7,571,773 | B1 | 8/2009 | West et al. | |
| 7,735,548 | B2 | 6/2010 | Cherewyk | |
| 8,136,585 | B2 | 3/2012 | Cherewyk | |
| 8,256,514 | B2 | 9/2012 | Winzer | |
| 2010/0326674 | A1 | 12/2010 | Nguyen et al. | |
| 2011/0030974 | A1 | 2/2011 | Nguyen | |
| 2012/0273198 | A1 | 11/2012 | Gette et al. | |
| 2013/0153237 | A1 * | 6/2013 | McGuire | 166/318 |
| 2013/0228326 | A1 * | 9/2013 | Griffith et al. | 166/75.15 |

FOREIGN PATENT DOCUMENTS

CN 202628063 * 12/2012

* cited by examiner

*Primary Examiner* — William P Neuder
(74) *Attorney, Agent, or Firm* — Eubanks PLLC

(57) ABSTRACT

A ball launcher system is provided. In one embodiment, such a system includes a ball launcher having a rotatable sleeve installed within an internal bore of a hollow body. The hollow body has ball chutes extending from an external surface to the internal bore. The rotatable sleeve has one or more holes that can be sequentially aligned with the ball chutes by rotation of the sleeve to enable balls within the ball chutes to pass sequentially into a well through the one or more holes. Additional systems, devices, and methods are also disclosed.

16 Claims, 12 Drawing Sheets

BALL LAUNCHER

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly through which the resource is accessed or extracted. These wellhead assemblies may include a wide variety of components, such as casing heads, tubing heads, and other connected components, that facilitate drilling or extraction operations.

In some instances, balls (e.g., frac balls used for fracturing operations) are used in wells to actuate downhole components, to seal the wells, or to carry out other functions. These balls are often pumped down wells with pressurized fluids (e.g., fracturing fluid) to perform their intended functions. Pressure at the wellhead can then be lowered so that pressurized fluid in the wellbore returns the balls to the surface.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to devices for introducing balls into wells. In one embodiment, such a device (referred to herein as a ball launcher or ball injector) includes a hollow body with an internal sleeve. Balls can be installed in the body of the ball launcher, such as within ball chutes leading from the outside of the body to the internal sleeve. The internal sleeve includes one or more holes sized to permit balls to pass through the holes. The sleeve can be rotated to align its holes with the ball chutes to allow the balls therein to pass through the holes and then fall into the well. The holes and chutes can be staggered to allow balls to be dropped sequentially (e.g., from smallest to biggest) through the sleeve as it is rotated. The chutes can be formed at a declining angle into the body such that gravity biases balls in the chutes toward the rotatable sleeve. Biasing devices could also or instead be used to bias the balls in the chutes toward the rotatable sleeve and, when holes are aligned with the chutes, to push the balls through the holes into the sleeve for introduction into the well.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
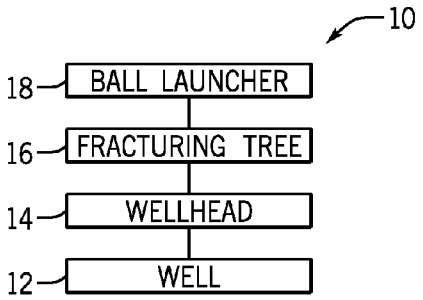
FIG. 1 is a block diagram representing a wellhead assembly including a ball launcher in accordance with an embodiment of the present disclosure.

Turning now to the present figures, a system 10 in the form of a wellhead assembly is generally depicted in FIG. 1 in accordance with one embodiment. Notably, the system 10 facilitates production of a resource, such as oil or natural gas, from a well 12. As depicted, the system 10 includes a wellhead 14 installed at the well 12. The wellhead 14 can include various components, such as one or more casing heads or tubing heads installed above various casing or tubing in the well 12.

The system 10 also includes a fracturing tree 16 for fracturing the well 12 and enhancing production. By way of example, resources such as oil and natural gas are generally extracted from fissures or other cavities formed in various subterranean formations. The well 12 can penetrate a resource-bearing formation and be subjected to a fracturing process that creates one or more man-made fractures in the formation. This facilitates coupling of pre-existing fissures and cavities, allowing fluids in the formation to flow into the well 12. For instance, in hydraulic fracturing, a fracturing fluid (e.g., a slurry including sand and water) can be pumped into the well 12 through the fracturing tree 16 to increase the pressure inside the well 12 and form the man-made fractures noted above. Such fracturing often increases both the rate of production from the well and its total production.

The system 10 also includes a ball launcher 18 for introducing balls into the well 12. In some embodiments, the ball launcher 18 can be used to drop frac balls into the well 12, as described below with respect to FIG. 2. But it is noted that the ball launcher 18 could also be used to drop other balls into a well, such as balls that actuate downhole tools or other components or balls that seal a portion of the well for purposes other than fracturing.

Figure 2:
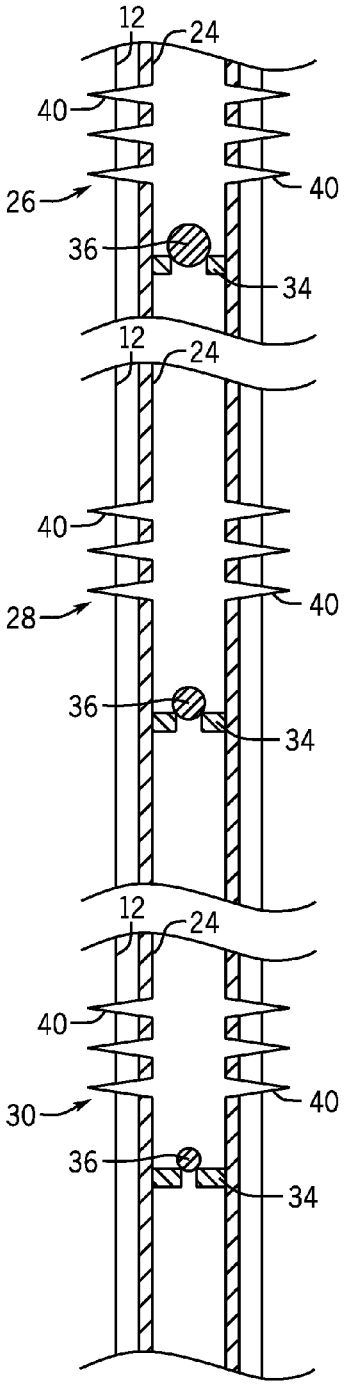
FIG. 2 schematically depicts the use of balls to seal portions of a well in accordance with one embodiment.

One example of the use of balls in the well 12 for fracturing is generally illustrated in FIG. 2. In this embodiment, the well 12 includes a casing 24. The well 12 is depicted as having zones or sections 26, 28, and 30. Each of these sections of the well 12 can be isolated from another portion further downhole in the well through the use of frac balls introduced into the well. As presently shown, the casing 24 includes baffles or packers 34 with openings for allowing fluid flow and for receiving balls 36. Although three balls 36 (with three corresponding packers 34) are shown in FIG. 2 for explanatory purposes, it will be appreciated that the well 12 can include any number of desired zones that can be isolated with respective sets of packers 34 and balls 36. Further, the packers 34 may be provided as part of sliding sleeve assemblies in which the balls 36 can be seated on the packers 34 such that pressure on the balls 36 cause sliding sleeves to move to expose ports in the casing 24. In this manner, the balls 36 can be used to selectively open the sleeves to facilitate access to a formation through the ports (e.g., to enable fracturing of the formation via the ports).

In the depicted embodiment, the packers 34 are designed to receive balls 36 of different sizes. More specifically, the packer 34 furthest from the surface in the well 12 has the smallest opening and receives the smallest ball 36. Moving up the well 12 from that packer 34, additional packers 34 have openings to receive balls 36 of increasing size. That is, the closer the packer 34 is to the surface, the larger the ball 36 it is intended to receive.

By way of example, during a fracturing operation, the smallest ball 36 can be introduced into the well (e.g., along with fracturing fluid) and that ball 36 can pass through openings of diminishing size in the other packers 34 until it reaches the packer 34 furthest from the surface (corresponding to zone 30 in FIG. 2). Fracturing fluid can be pumped through ports 40 in the casing 24 in zone 30 to fracture the surrounding formation. The ports 40 may be formed in any suitable manner. For example, the ports 40 can be formed in the casing 24 before installation, or they can be formed by perforating the casing 24 after it is installed in the well 12. The next ball 36 can then be introduced (e.g., to engage the next packer 34 that isolates zone 28 from zone 30) and fracturing of zone 28 may also be performed. The process of dropping a ball 36 to engage a packer and fracturing the zone above the packer (e.g., through ports 40) can be repeated with frac balls of increasing size (that is, from smallest to largest). In at least some embodiments, all of the balls 36 can be returned to the surface together (e.g., by wellbore pressure) after fracturing of the well 12 is completed. But in other embodiments, each ball 36 can be returned after fracturing a respective zone of the well 12, or groups of balls 36 can be returned together after fracturing multiple zones. In other instances, the balls 36 could be left in the well 12 (e.g., to be drilled out later or, for balls of certain materials, to dissolve on their own).

Figure 3:
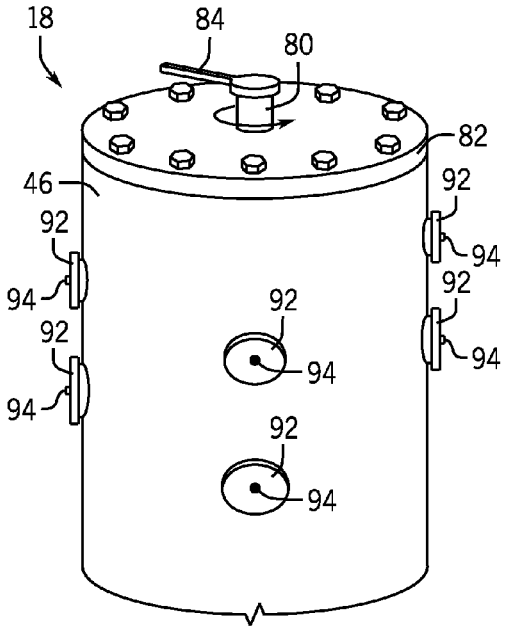
FIG. 3 is a front elevational view of a ball launcher for introducing balls into a well in accordance with one embodiment.
Figure 4:
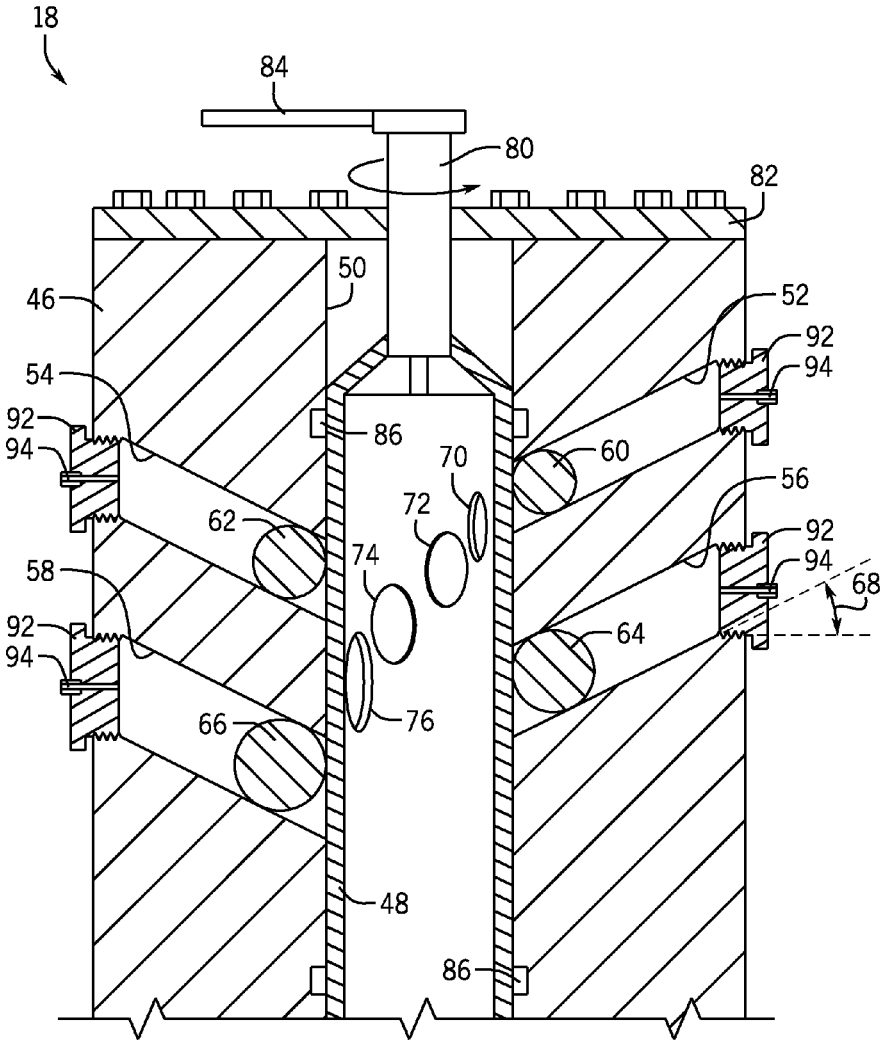
FIG. 4 is a cross-section of the ball launcher of FIG. 3, showing a rotatable sleeve with holes for enabling balls in the ball launcher to be selectively dropped into a well in accordance with one embodiment.

One example of a ball launcher 18 for introducing balls into the well 12 is generally shown in FIGS. 3 and 4. As depicted in these figures, the ball launcher 18 includes a hollow body 46 and an internal sleeve or cage 48 received within a bore 50 of the body 46. The body 46 includes various conduits (also referred to herein as ball chutes) extending from the outside of the body 46 to the bore 50 for receiving balls to be introduced into the well 12.

As shown in FIG. 4, these conduits include ball chutes 52, 54, 56, and 58. But the body 46 can include any desired number of ball chutes arranged in various manners about the internal bore 50 of the body 46. For instance, the body 46 of one embodiment includes eight ball chutes in the form of pairs of ball chutes spaced at ninety-degree intervals about the bore 90. This is consistent with the embodiment depicted in FIGS. 3 and 4, with ball chutes 52 and 56 shown on the right, ball chutes 54 and 58 shown on the left, with two additional chutes on the front of the body 46 in FIG. 3 (behind the front-facing seal caps 92) and an additional two chutes on the rear of the body 46 in FIG. 3 (and obscured by the sleeve 48 in FIG. 4). In this embodiment, the ball chutes are arranged in a helical pattern of increasing chute size arranged counter-clockwise about the body 46, in which the ball chute 52 has the smallest diameter and the upper ball chute hidden in the back of the body 46 in FIG. 3 has the next smallest diameter. This is followed, with increasing diameters, by the ball chute 54, the upper ball chute in the front of the body 46 in FIG. 3, and continuing helically about the body 46 again until reaching the lower ball chute in the front of the body 46 in FIG. 3 (which has the largest diameter). But it is again noted that the ball chutes could be arranged in any other desired manner.

The ball chutes can receive balls of varying sizes in preparation for dropping the balls into the well. For instance, the ball chutes depicted in partial section views of FIGS. 4 and 5 include balls 60, 62, 64, and 66 (numbered in order of increasing size). The other ball chutes (i.e., the two in the front of the body 46 in FIG. 3 and two more opposite those in the front, as described above) can also receive balls, with the size of each ball differing according to the size of the ball chute in which it is received.

In at least some embodiments, the ball chutes are formed at a declining angle 68 through the body 46 so that gravity biases the balls through the ball chutes toward the internal sleeve 48. The angle 68 can be of any suitable magnitude to allow gravity to draw the ball downward toward the sleeve 48, such as fifteen degrees or twenty degrees.

Figure 5:
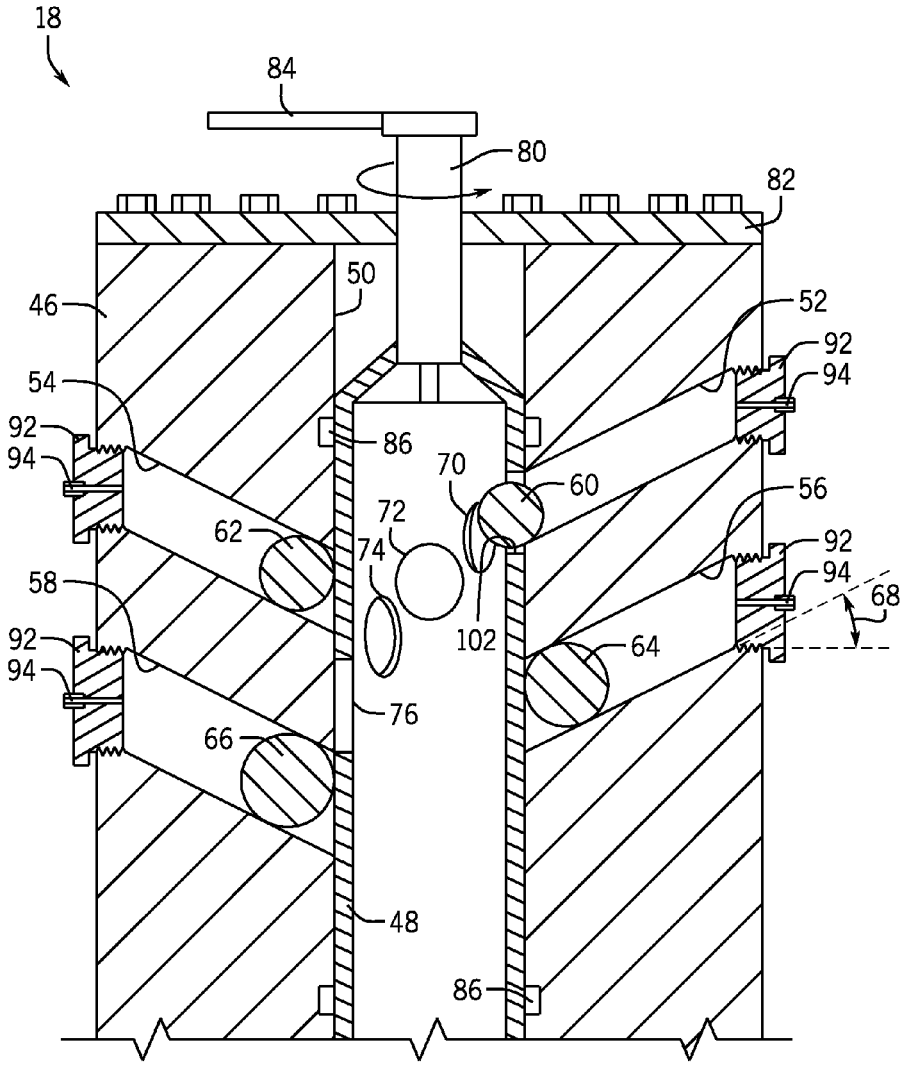
FIG. 5 is also a cross-section of the ball launcher of FIGS. 3 and 4, in which the rotatable sleeve has been rotated from its position depicted in FIG. 4 to a position in which a hole in the sleeve is aligned with a ball to allow the ball to pass through the hole and into the sleeve for introduction to the well in accordance with one embodiment.

The internal sleeve 48 includes one or more holes (e.g., holes 70, 72, 74, and 76 in FIG. 4), and the sleeve 48 can be rotated to align a hole with a ball chute to allow the ball within the ball chute to pass through the hole and into the sleeve. This ball can then fall through the sleeve 48 out of the ball launcher 18, through the wellhead 14 and any other components (e.g., the fracturing tree 16), and into the well 12. An example of this is generally depicted in FIG. 5, in which the sleeve 48 has been rotated counter-clockwise to cause a hole 102 in the sleeve 48 to align with the ball chute 52 so that ball 60 falls through the hole 102 (and then into the well 12). The sleeve 48 can continue to be rotated to align its holes with the other ball chutes to allow balls within those chutes to also fall into the well 12 through the sleeve 48. Fracturing of different zones of the well 12 can be performed after each ball is dropped from the ball launcher 18 (i.e., one zone can be fractured after dropping a first ball, and other zones can be fractured after dropping subsequent balls). In the embodiment depicted in FIGS. 3-5, continued counter-clockwise rotation of the sleeve 48 from the position depicted in FIG. 5 causes balls loaded in the ball chutes to drop sequentially in order of size. The holes of the sleeve 48 can be arranged helically or in any other desired manner. Additionally, the sleeve 48 may have any desired number of ports or holes for allowing the balls to pass through the sleeve. In some embodiments, the number of such holes is equal to the number of ball chutes. In others, the sleeve includes only one or two holes that can be aligned with a greater number of ball conduits. Further, the sleeve 48 in some embodiments can be moved vertically within the body 46, such as via a thread on stem 80, to facilitate vertical alignment of the holes of the sleeve 48 with ball conduits.

Seals 86 provide sealing engagement with the body 46 and the sleeve 48 while permitting rotation of the sleeve 48 within the body 46. In some instances, the ball launcher 18 could be isolated from wellbore pressure while dropping balls 36 into the well 12 (e.g., with isolation valves of the wellhead assembly), while in others the ball launcher 18 could be operated at wellbore pressure to drop the balls. Caps 92 are installed in the body 46 to seal the ball conduits and inhibit fluid from passing out of the launcher 18 through the ball conduits. The caps 92 include vents 94 to allow excess pressure to escape from the conduits.

The sleeve 48 can be rotated in any suitable manner. In the presently depicted embodiment, the sleeve 48 is attached to a stem 80 extending through an end cap 82 of the body 46. A handle 84 connected to the stem 80 allows a user to manually rotate the sleeve 48 to sequentially drop the balls into the well. But in other embodiments, including some embodiments described below, the sleeve 48 can be rotated in an automated fashion.

Figure 6:
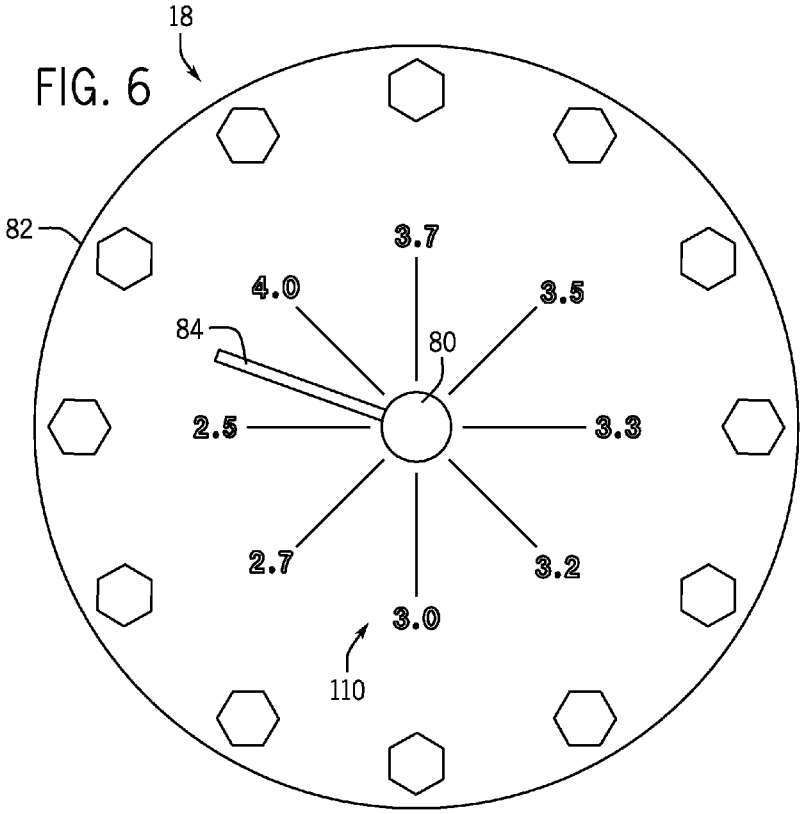
FIG. 6 is a plan view of an end cap of the ball launcher having a stem that controls rotation of the internal sleeve in accordance with one embodiment.
Figure 7:
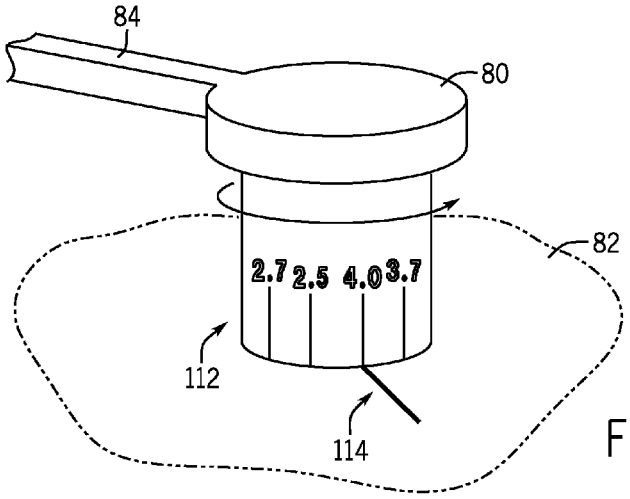
FIG. 7 is a perspective view of the stem for rotating the sleeve of the ball launcher, the stem depicted as having alignment indicia to facilitate manual operation of the ball launcher in accordance with one embodiment.

In some embodiments in which the sleeve 48 is rotated manually with a handle 84, various indicia can be provided on components of the ball launcher 18 to aid an operator in recognizing alignment of the sleeve 48 to drop balls 36 of various sizes. For example, indicia 110 can be provided on an upper surface of the ball launcher body 46 (e.g., on the cap 82) or indicia 112 can be provided elsewhere (e.g., on the stem 80), as generally depicted in FIGS. 6 and 7. Though the indicia of other embodiments may differ, the indicia 110 and 112 of these figures include alignment marks and numerals representative of the sizes of the balls to be dropped through the sleeve 48. In the embodiments depicted in FIGS. 6 and 7, the eight balls to be dropped by the launcher 18 range in size from 2.5 inches to 4.0 inches (63.5 mm to 102 mm) with the indicia including a corresponding marking for each ball size. Of course, if different ball sizes are used in other embodiments, the indicia may be chosen based on those different ball sizes. In the embodiment of FIG. 6, the handle 84, the sleeve 48, and the indicia 110 are arranged such that the sleeve 48 allows the each ball to drop through the sleeve when the handle 84 is aligned with the corresponding numeral of the indicia 110. In the embodiment of FIG. 7, the indicia 112 are arranged on the stem 80 such that the balls are sequentially launched through the sleeve 48 as the corresponding numerals of the indicia 112 are aligned with a reference point (e.g., mark 114) on the ball launcher 18.

Figure 8:
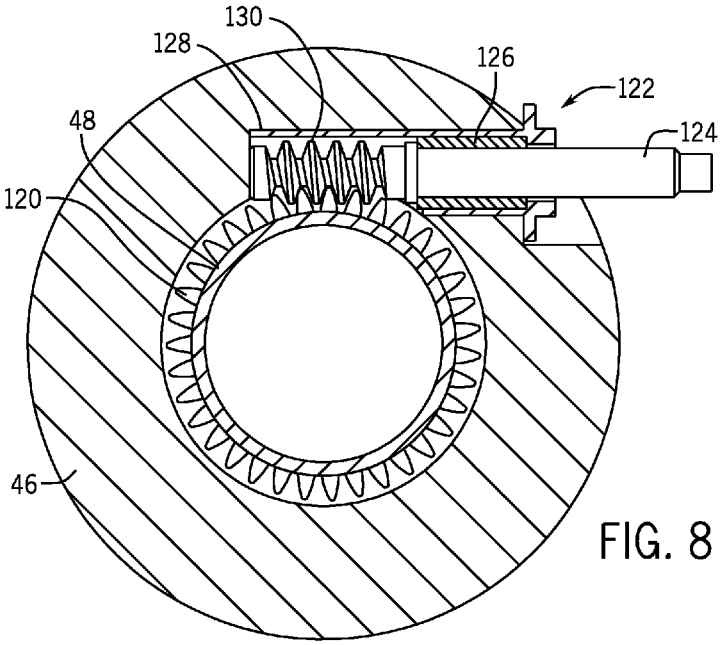
FIG. 8 is a cross-section of a worm gear that can be used to rotate the internal sleeve of the ball launcher in accordance with one embodiment.
Figure 9:
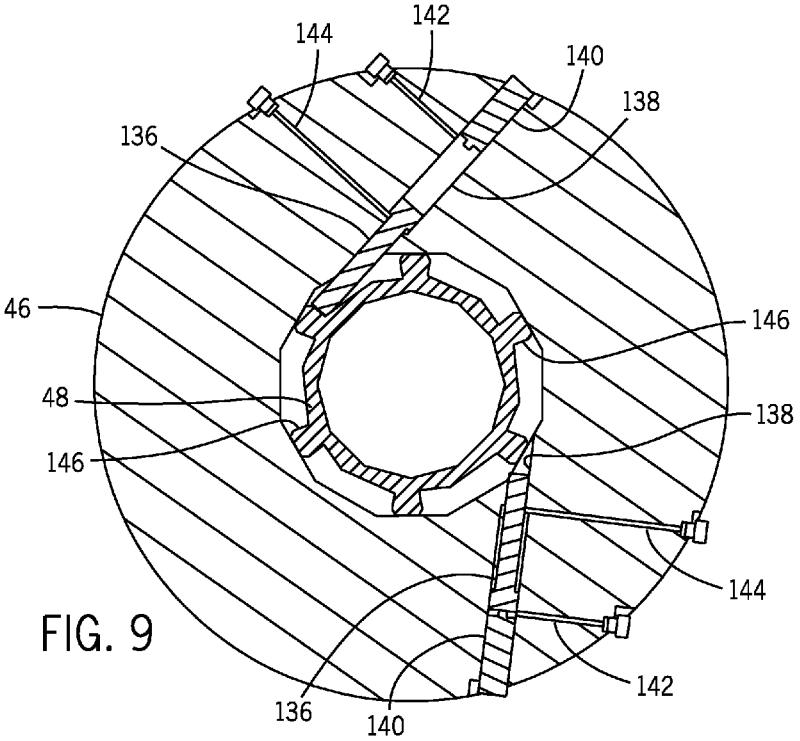
FIG. 9 is a cross-section of pistons that can be used to drive rotation of an internal sleeve of the ball launcher in accordance with another embodiment.

Examples for rotating the sleeve 48 in an automated manner are depicted in FIGS. 8 and 9. More specifically, in the embodiment shown in FIG. 8 the ball launcher 18 includes a worm gear assembly 122 for driving rotation of the sleeve 48 via a gear 120. The assembly 122 includes a rotatable worm 124 within a bushing 126 and a housing 128 installed in the body 46 of the ball launcher 18. Rotation of the worm 124 causes thread 130 to move with respect to teeth of the gear 120, thereby causing rotation of the sleeve 48. The worm 124 can be driven in any suitable fashion, such as by a motor attached to the distal end of the worm 124 opposite the threads 130.

In FIG. 9, the ball launcher 18 includes a set of pistons 136 provided in chambers 138 through the body 46 and closed at their outer ends with seal plugs 140. The pistons 136 are driven by applying control fluid (e.g., hydraulic fluid) through supply ports 142 and 144. The pistons 136 are synchronized to alternate such that a first piston engages with a tab 146 formed on the sleeve 48 to drive rotation of the sleeve 48 while a second piston is retracted within its chamber 138. The positions of these pistons 136 may then be reversed, with the second piston extending into engagement with another tab 146 to drive rotation of the sleeve 48 while the first piston retracts. By alternating in this manner, the sleeve 48 can be rotated to allow the balls to drop into the well 12. In some embodiments, the tabs 146 are aligned about the sleeve 48 such that a hole in the sleeve aligns with a ball conduit to drop a ball into the well each time either piston 136 moves to its fully extended position from its chamber 138. For instance, the sleeve 48 could have six holes, corresponding to the six depicted tabs 146, for allowing balls to drop from their conduits through the sleeve, or the sleeve 48 could have eight tabs 146 corresponding to eight holes in the sleeve for the eight ball conduits described above.

Figure 10:
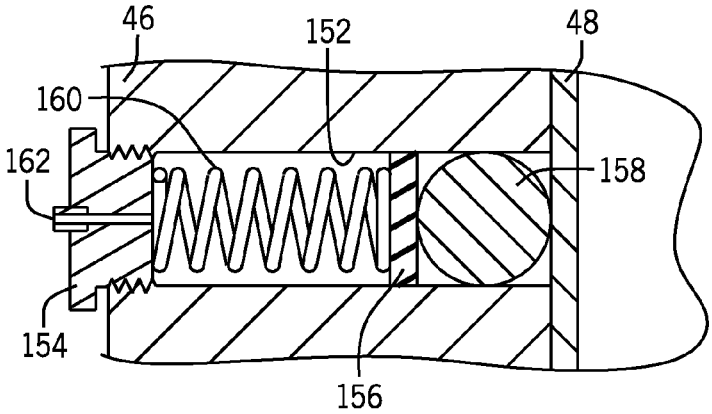
FIGS. 10 and 11 are section views of ball chutes (conduits) in the ball launcher having devices that bias balls in the chutes toward the rotatable sleeve of the ball launcher in accordance with certain embodiments.
Figure 11:
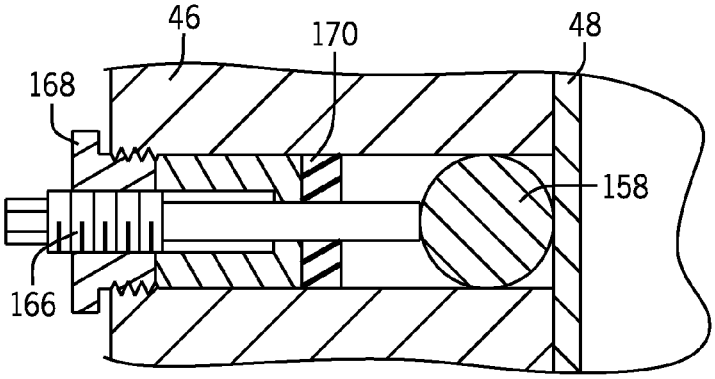

The ball conduits of the launcher 18 can also include devices to bias balls 36 through holes in the sleeve 48. For instance, in FIG. 10, a ball conduit or chute 152 includes a biasing spring 160 provided between a seal cap 154 (depicted as including a vent 162) and a ball stop 156. When a ball 158 is installed between the stop 156 and the sleeve 48, compression of the spring 160 biases the ball 158 toward the sleeve 48. When the sleeve 48 is then rotated to align a hole in the sleeve with the ball 158, the spring 160 expands to push the ball 158 through the hole and into the well 12. By way of further example, a drive screw 166 is depicted in FIG. 11 for pushing the ball 158 through a hole in the sleeve 48. Particularly, the drive screw 166 is provided through a gland 168 and a seal 170. Once a hole in the sleeve 48 is aligned with the ball 158, the drive screw 166 can be rotated so that it translates with respect to the seal 170 and pushes the ball 158 out of the ball conduit through the hole. The drive screw 166 can be driven manually or automatically (e.g., by a motor). Biasing devices, such as those depicted in FIGS. 10 and 11, can be used to supplement gravitational pull on the balls in conduits that are angled downward toward the sleeve 48, or can be used with conduits that are formed without a declined angle (in which gravity does not draw the balls toward the sleeve 48). The ball chutes of FIGS. 10 and 11 can be formed perpendicularly or at some other angle with respect to the outer circumferential wall of the sleeve 48.

Figure 12:
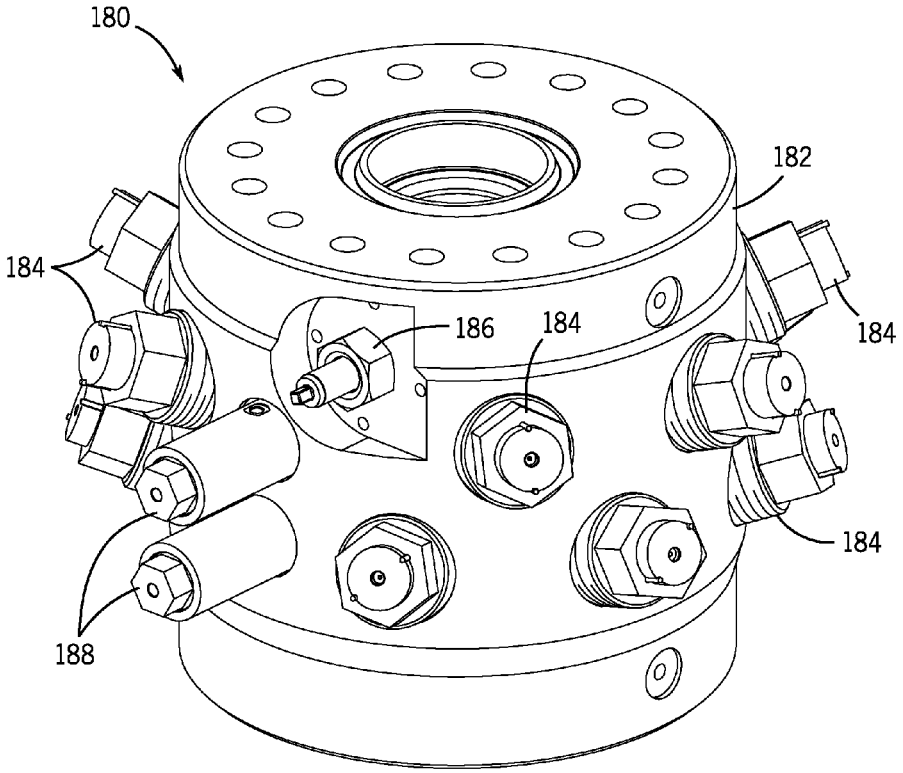
FIG. 12 depicts a ball launcher having dispensers installed within ball conduits in accordance with one embodiment.
Figure 13:
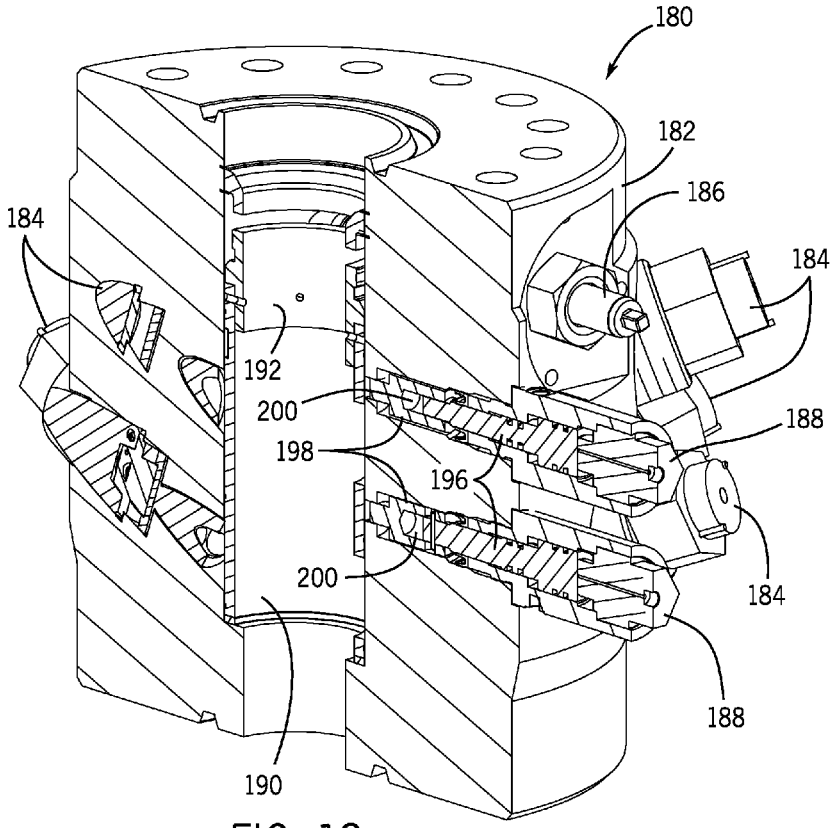
FIG. 13 is a section view of the ball launcher depicted in FIG. 12.

In some embodiments, the ball conduits of a ball launcher include dispensers for receiving the balls and pushing the balls into the well through a rotating sleeve. One example of such a ball launcher is depicted in FIGS. 12 and 13. In these figures, the depicted ball launcher 180 includes a hollow body 182 with dispensers 184 installed in ball conduits extending through to a rotatable sleeve 190 in the body 182. As discussed in greater detail below, the dispensers 184 receive balls and push those balls through one or more holes in the sleeve 190 to drop the balls into the well 12. The ball launcher 180 includes fourteen dispensers arranged about the body 182, with upper and lower sets of dispensers that are radially staggered with respect to one another. But other embodiments can include any number of ball conduits, with or without dispensers.

The ball launcher 180, in at least some embodiments, is modular with different bodies constructed to receive differing ranges of ball sizes. For instance, the ball launcher 180 could include one body (e.g., the body 182 depicted in FIG. 12) for receiving and launching fourteen balls with diameters ranging from 0.875 inches to 2.5 inches (22.2 mm to 63.5 mm) in increments of 0.125 inches (3.2 mm) and a second body for receiving and launching ten additional balls with diameters ranging from 2.625 to 3.75 inches (63.5 mm to 95.3 mm) in increments of 0.125 inches (3.2 mm). In other embodiments, the ball launcher could include one or more bodies for receiving and launching balls any desired range of ball sizes in any desired increments, such as from 0.875 inches to 5.0 inches (22.2 mm to 127 mm) in 0.0625-inch (1.6-mm) increments. Further, the ball launcher could be constructed to enable the launch of multiple balls of any given size (e.g., by including two balls of the same size in adjacent ball conduits).

The ball launcher 180 also includes a worm gear assembly 186 for rotating the sleeve 190 within the body 182. The worm gear assembly 186 may operate similarly to the worm gear assembly 122 discussed above with respect to FIG. 8, with the worm being rotated to transmit torque to the sleeve 190 via an attached collar 192. Of course, in other embodiments the worm gear can transmit torque directly to the sleeve 190.

Lock pins 188 of the launcher 180 provide a hard stop to the sleeve 190 when a hole of the sleeve 190 is aligned with a dispenser 184 to allow a ball to drop into the well through the hole. The lock pins 188 are depicted in FIG. 13 as hydraulic lock pins having pistons 196 and tips 198. The tips 198 are hollow to provide chambers 200 between the tips 198 and the pistons 196, and springs (not shown) are installed in the chambers 200 to bias the tips 198 toward the sleeve 190.

Figure 14:
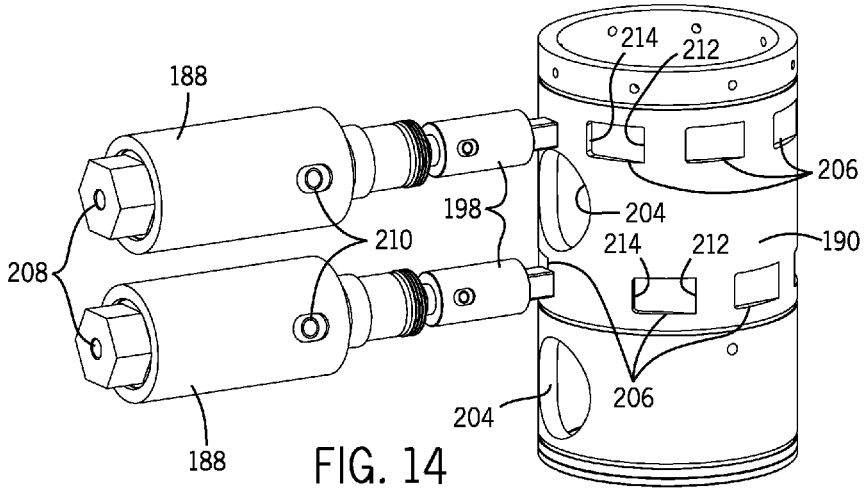
FIG. 14 depicts the internal sleeve and two locking pins of the ball launcher of FIG. 12 in accordance with one embodiment.
Figure 15:
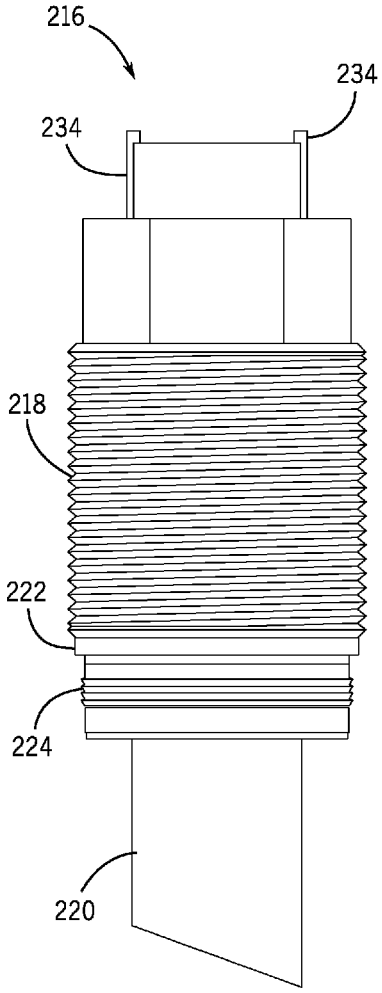
FIGS. 15 and 16 depict a hydraulic ball dispenser in accordance with one embodiment.
Figure 16:
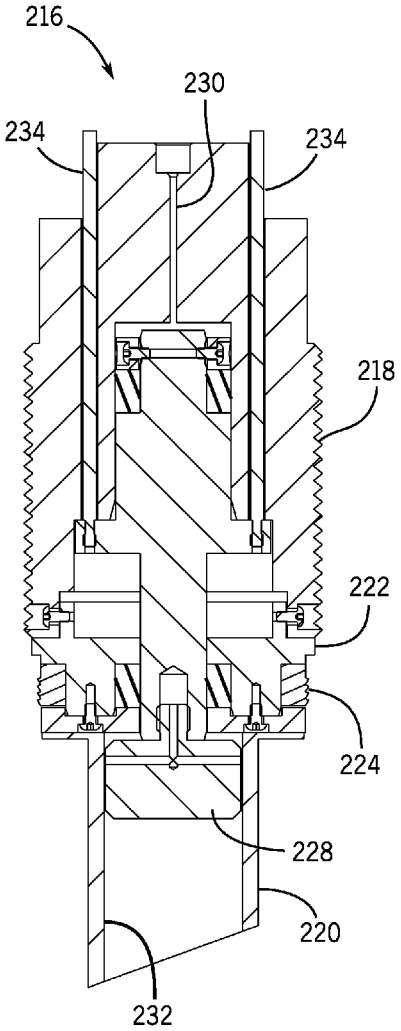

Additional details with respect to the lock pins 188 and the sleeve 190 are illustrated in FIG. 14, which generally depicts these components as removed from the body 182 for clarity. The sleeve 190 includes two holes 204, and rotation of the sleeve 190 allows balls in the ball conduits of the body 182 to be sequentially dropped through these holes and into the well. The depicted sleeve 190 also includes recesses 206 for engaging the tips 198 of the lock pins 188 and providing a hard stop for each dispenser 184. Particularly, the tips 198 can be extended into engagement with the outer surface of the sleeve 190 by hydraulically actuating the pistons 196 via the ports 208. Springs in the chambers 200 bias the tips 198 toward the sleeve 190 and counter-clockwise rotation of the sleeve 190 causes the tips 198 to slide into the recesses 206 over edges 212 and then abut stop edges 214 of the recesses. The stop edges 214 interact with the received tips 198 to inhibit further rotation of the sleeve 190.

The recesses 206 are positioned about the sleeve 190 such that each time a stop edge 214 prevents rotation of the sleeve 190, one of the holes 204 in the sleeve 190 is aligned with a ball conduit associated with the recess 206 engaged by the tip 198. For example, the sleeve 190 can be rotated counter-clockwise until the tip 198 of the lower lock pin 188 engages the recess 206 shown just behind the end of that tip 198 in FIG. 14. Once a corresponding ball has been dropped through the lower hole 204 of the sleeve 190, the tip 198 can be retracted from that recess 206 (via hydraulic pressure provided to the piston 196 via port 210) to allow continued rotation of the sleeve 190. As the sleeve 190 continues its rotation, the tip 198 of the upper lock pin 188 can be extended so that it will engage another recess 206 that inhibits further rotation and allows a ball to drop through the upper hole 204 of the sleeve. The tip 198 of the upper lock pin 188 can then be retracted to allow further rotation of the sleeve 190, and the lower lock pin 188 can be extended so that it can engage the next lower recess 206. In this manner, the lock pins 188 can be alternatingly extended and retracted to engage the recesses 206 and provide a hard stop when the holes 204 are aligned with ball conduits. In other embodiments, however, an optical encoder could be used instead to detect the position of the sleeve relative to the ball conduits and a controller could use such information to stop the sleeve as a hole is aligned with each ball conduit. In such embodiments, the locking pins 188 and the recesses 206 could be omitted. Additionally, in at least some embodiments the sleeve 190 has the ability to be rotated forward (e.g., through the sequence of balls from smallest to largest) as well as backward. In the event of a failed ball launch, the sleeve can be rotated in reverse (e.g., to the conduit from which the previous ball was launched), the dispenser 184 in the conduit having the failed launch can be removed, and a ball can be reloaded into the conduit. The sleeve 190 could then be rotated forward to return to that conduit to launch the ball.

As noted above, in some embodiments a ball launcher includes ball conduits with dispensers. For example, the dispensers 184 of FIG. 12 generally operate to ensure that balls are launched from the ball conduits when the holes in the sleeve 190 are rotated into alignment with the conduits. While gravity may cause the ball to drop through the holes on their own, the dispensers 184 can be actuated to ensure that balls do not remain stuck in the conduits (e.g., from debris or some other obstruction).

The dispensers 184 can be provided in any suitable form, two examples of which are provided in FIGS. 15-18. The first example is a hydraulic dispenser 216 depicted in FIGS. 15 and 16 in accordance with one embodiment. The hydraulic dispenser 216 includes a threaded body 218 that allows it to be threaded into a mating ball conduit of the body 182. A hollow stem 220 is connected to the body 218 by a collar 222, and a seal 224 inhibits fluid within the bore of the ball launcher 180 from leaking out through the ball conduit in which the dispenser 216 is installed. The dispenser 216 includes a piston 228 that is actuated with hydraulic control fluid provided via conduit 230. Particularly, the piston 228 can be extended within bore 232 of the stem 220 toward the hole 204 of the sleeve 190. The piston 228 is connected to visual indicator rods 234. When the piston 228 is retracted, these visual indicator rods 234 extend out from the body of the dispenser 216 to signal to an operator that the piston 228 has not been extended and that a ball may be present within the dispenser. When a ball is to be dropped from the dispenser 216, the piston 228 is then extended to occupy the space previously occupied by the ball (which either fell through the hole 204 in the sleeve 190 due to gravity or was pushed out by the piston 228). When the piston 228 is fully extended, the visual indicator rods 234 are retracted (either partially or fully) into the body 218 to indicate the position of the piston 228 and to signal that the ball is no longer within the dispenser 216. Any number of visual indicator rods 234 could be used, and in some embodiments these rods 234 are a different color than the upper portion of the body 218 to make it easier for an operator to determine whether the ball has been launched out of conduit and into a well.

Figure 17:
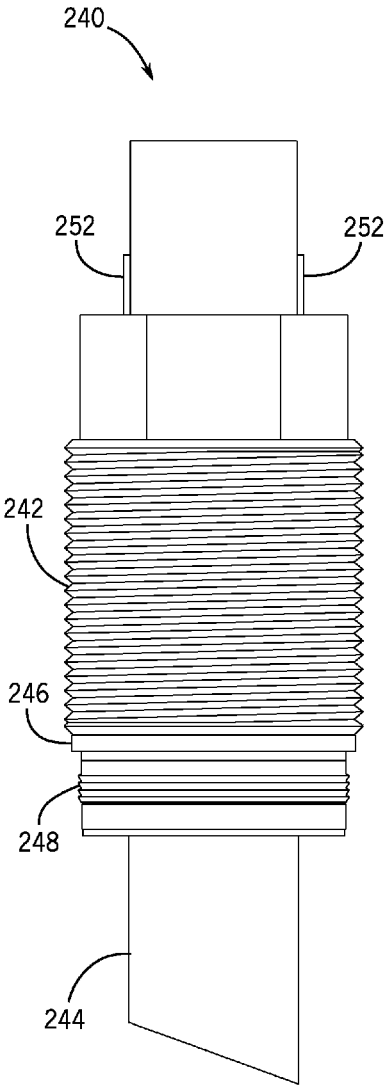
FIGS. 17 and 18 depict a spring ball dispenser in accordance with another embodiment.
Figure 18:
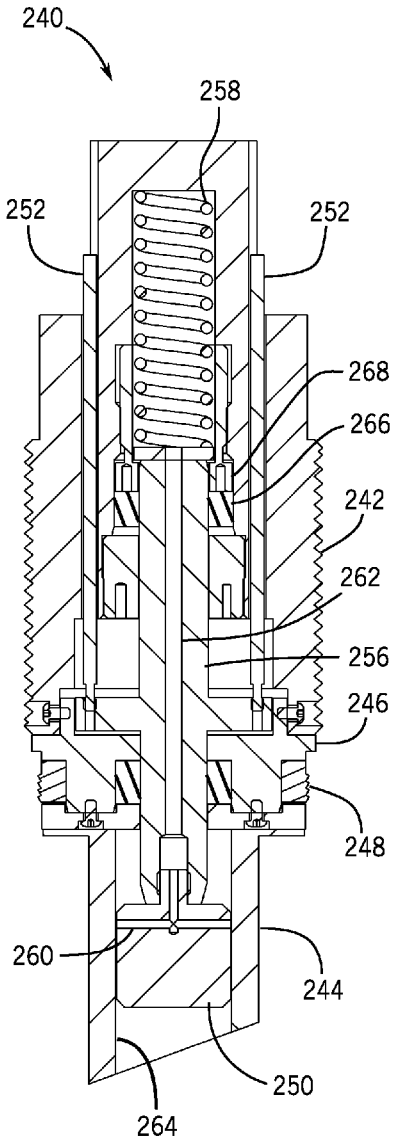

The second example is a spring dispenser 240 depicted in FIGS. 17 and 18 in accordance with another embodiment. Like the hydraulic dispenser 216, this spring dispenser 240 includes a threaded body 242, a stem 244, a collar 246, and a seal 248. The dispenser 240 further includes a piston 250 that can be extended within a bore 264 of the stem 244 to ensure that a ball received in the stem 244 has been launched through the sleeve 190. In lower-pressure environments, a spring 258 biases the piston 250 toward the sleeve 190 to ensure that a received ball drops through the hole in the sleeve. But the dispenser 240 is also constructed to balance pressures and create a pressure differential that biases the piston 250 toward the sleeve 190 when exposed to higher pressures (e.g., wellbore pressures). Particularly, when the bore 264 of the dispenser 240 is exposed to pressurized fluid from the bore of the ball launcher 180, this fluid is routed through conduits 260 and 262 to a spring chamber at the rear side of the piston stem 256. The fluid in this chamber is contained by seal 266. Due to differences in the surface areas exposed, fluid pressure on the upper surface of the seal 266 (adjacent the lower edge of the spring bushing 268 in FIG. 18) and on the upper portion of the stem 256 in the spring chamber exceeds the fluid pressure on the bottom surface of the piston 250 within the bore 264, and this pressure differential drives the piston toward the sleeve 190 when the ball is launched through the sleeve. The spring dispenser 240 also includes visual indicator rods 252 to alert an operator as to the position of the piston 250 and to verify when a ball has been launched from the dispenser.

Figure 19:
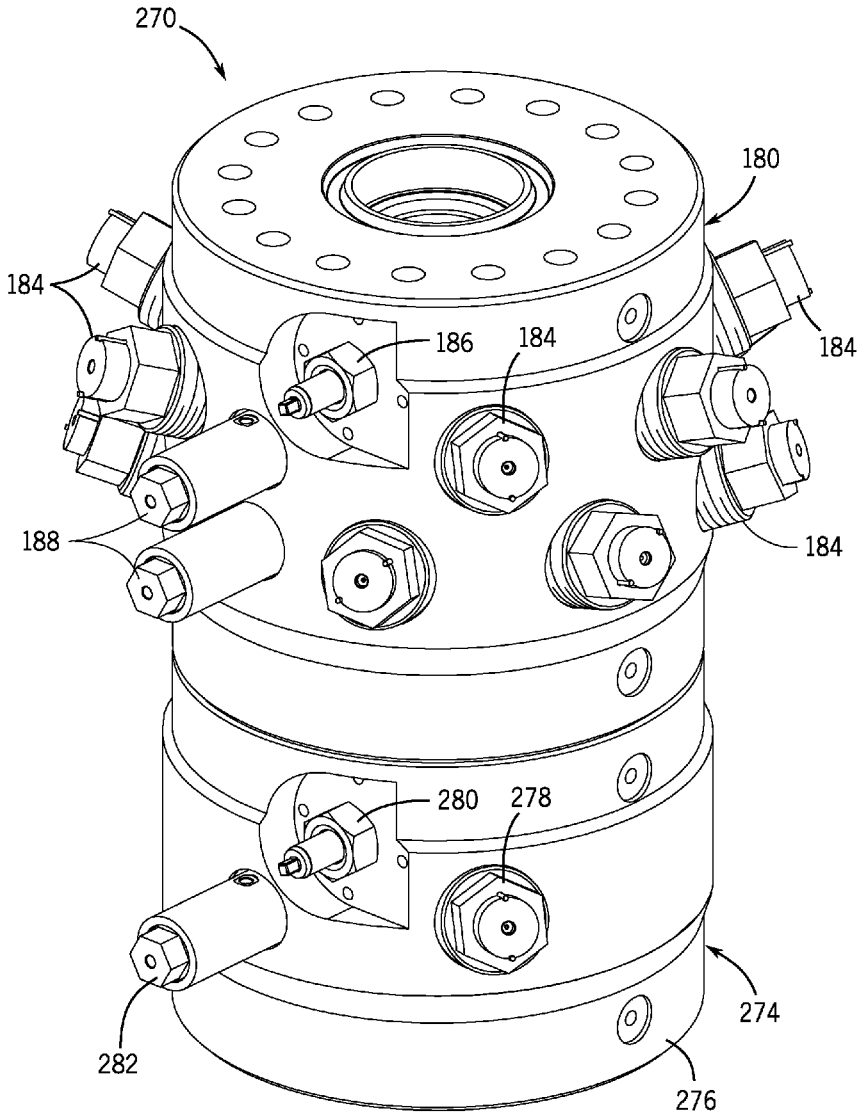
FIG. 19 illustrates a modular ball launcher formed of multiple individual ball launchers in accordance with one embodiment.

A ball launcher 270 is depicted in FIG. 19 in accordance with another embodiment. The ball launcher 270 is a modular system having the ball launcher 180 and an additional ball launcher 274. In the presently depicted embodiment, the additional ball launcher 274 includes a body 276, a worm drive 280 (which drives a rotating sleeve in the body 276), and a lock pin 282, each of which functions similarly to the analogous components of the ball launcher 180. The ball launcher 274 is depicted as including a single dispenser 278 which, like dispensers 184, can take any suitable form. In one embodiment, the dispenser 278 is sized large enough to accept any of the balls that can be dropped from the dispensers 184, and can be used to launch a replacement ball in the event that a given ball does not launch from one of the dispensers 184. In other embodiments, the ball launcher 274 may include multiple dispensers 278.

Figure 20:
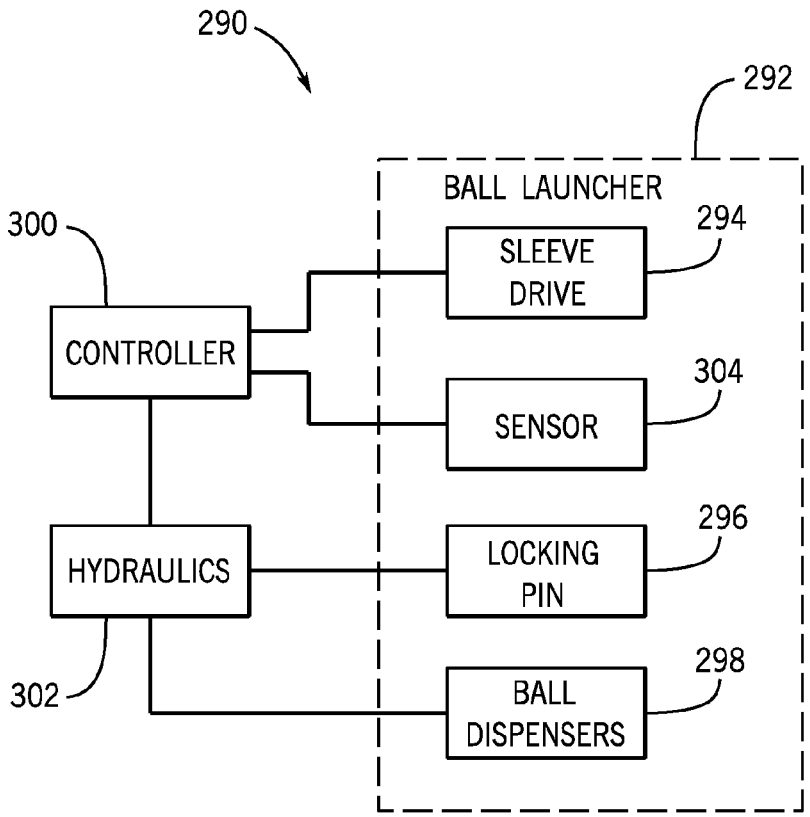
FIG. 20 is a block diagram generally depicting a system in which a controller and hydraulic system are used to operate a ball launcher in accordance with one embodiment.

Finally, it will be appreciated that ball launcher components can be controlled in any suitable manner. For instance, as generally depicted in block diagram 290 of FIG. 20, a ball launcher 292, which could include one or more of the ball launchers described above, has a sleeve drive 294 (e.g., a worm drive with a motor), a locking pin 296, and ball dispensers 298. The ball launcher 292 can be operated with a programmed controller 300 and a hydraulic system 302 (e.g., a pump and a control fluid source) that collectively perform the control functionality described herein. In some embodiments, the controller 300 commands operation of the sleeve drive 294 to rotate an inner sleeve (e.g., sleeve 190) and allow balls to be dropped into a well, and also commands operation of the hydraulic system 302 to control operation of the locking pin 296 and the ball dispensers 298. A sensor 304 detects that a hole in a sleeve has been rotated into alignment with a ball dispenser 298. In one embodiment, the sensor 304 is a torque sensor and the controller correlates a sharp increase in torque on the sleeve with engagement of the locking pin 296 with a stop face of a recess in the sleeve, as described above. The controller 300 can then deactivate the sleeve drive and cause the hydraulic system 302 to actuate the piston of a hydraulic ball dispenser 298 to ensure that its ball has dropped through the sleeve. The actuation of the piston of the hydraulic ball dispenser can be performed automatically by the controller 300 or in response to a user input. While the sleeve in this example may be electrically actuated, in other embodiments the sleeve could be hydraulically actuated or driven manually.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a ball launcher including:

a hollow body having a plurality of ball chutes extending from an external surface to an internal bore;

a rotatable sleeve disposed in the internal bore of the hollow body, the rotatable sleeve including one or more holes that can be sequentially aligned with the plurality of ball chutes by rotation of the sleeve with respect to the hollow body to enable balls within the plurality of ball chutes to pass into a well through the one or more holes in sequence when the ball launcher is installed at a well; and dispensers installed in the plurality of ball chutes, wherein the dispensers include pistons positioned to be extended toward the rotatable sleeve to ensure launch of balls from the ball chutes, and wherein the dispensers include a spring dispenser constructed to route wellbore fluid through a piston of the spring dispenser to create a pressure differential that biases the piston toward the rotatable sleeve.

2. The system of claim 1, wherein the ball chutes of the plurality of ball chutes have different sizes to receive balls having different diameters, and the rotatable sleeve is configured to enable the balls having different diameters to pass from the plurality of ball chutes through the one or more holes in sequence from smallest to largest.

3. The system of claim 1, wherein the ball launcher includes a worm gear to enable rotation of the rotatable sleeve.

4. The system of claim 1, wherein the ball chutes of the plurality of ball chutes are formed at declined angles from the external surface to the internal bore.

5. The system of claim 1, wherein the one or more holes that can be sequentially aligned with the plurality of ball chutes by rotation of the sleeve with respect to the hollow body are equal in number to the number of ball chutes in the hollow body.

6. The system of claim 1, comprising a wellhead and a fracturing tree coupled between the wellhead and the ball launcher.

7. The system of claim 1, wherein the rotatable sleeve is sized to provide full bore access to the wellhead through the rotatable sleeve.

8. A system comprising:

a ball launcher including:

a hollow body having a plurality of ball chutes extending from an external surface to an internal bore;

a rotatable sleeve disposed in the internal bore of the hollow body, the rotatable sleeve including one or more holes that can be sequentially aligned with the plurality of ball chutes by rotation of the sleeve with respect to the hollow body to enable balls within the plurality of ball chutes to pass into a well through the one or more holes in sequence when the ball launcher is installed at a well; and dispensers installed in the plurality of ball chutes, wherein the dispensers include pistons positioned to be extended toward the rotatable sleeve to ensure launch of balls from the ball chutes and visual indicator rods coupled to the pistons that facilitate user verification that the balls have passed from the ball chutes through the one or more holes of the rotatable sleeve.

9. A system comprising:

a ball launcher including:

a hollow body having a plurality of ball chutes extending from an external surface to an internal bore;

a rotatable sleeve disposed in the internal bore of the hollow body, the rotatable sleeve including one or more holes that can be sequentially aligned with the plurality of ball chutes by rotation of the sleeve with respect to the hollow body to enable balls within the plurality of ball chutes to pass into a well through the one or more holes in sequence when the ball launcher is installed at a well; and a locking pin that engages a recess on the rotatable sleeve to inhibit further rotation of the sleeve when one of the one or more holes is aligned with a ball chute of the plurality of ball chutes.

10. A system comprising:

a ball launcher including:

a hollow body having a plurality of ball chutes extending from an external surface to an internal bore;

a rotatable sleeve disposed in the internal bore of the hollow body, the rotatable sleeve including one or more holes that can be sequentially aligned with the plurality of ball chutes by rotation of the sleeve with respect to the hollow body to enable balls within the plurality of ball chutes to pass into a well through the one or more holes in sequence when the ball launcher is installed at a well; and a locking pin that is hydraulically actuated and includes a spring-loaded tip biased toward the rotatable sleeve.

11. A method comprising:

rotating a sleeve within a ball injector coupled to wellhead equipment to align a hole through the sleeve with a first ball to cause the first ball to drop through the hole and into a well through the sleeve;

engaging a first recess on the sleeve with a locking pin to inhibit rotation of the sleeve when the hole through the sleeve is aligned with a conduit of the ball injector holding the first ball;

retracting the locking pin to permit rotation of the sleeve after the first ball has dropped through the hole; and further rotating the sleeve within the ball injector to align the hole or a different hole through the sleeve with a second ball to cause the second ball to drop through the hole or the different hole and into the well through the sleeve.

12. The method of claim 11, comprising:

engaging a second recess on the sleeve with an additional locking pin to inhibit rotation of the sleeve when the hole or the different hole through the sleeve is aligned with a conduit of the ball injector holding the second ball; and retracting the additional locking pin to permit rotation of the sleeve after the second ball has dropped through the hole or the different hole.

13. The method of claim 11, comprising operating a dispenser installed in the conduit of the ball injector to provide a visual confirmation that the first ball dropped through the hole.

14. The method of claim 11, wherein the second ball drops into the well through the same hole as the first ball.

15. The method of claim 11, comprising:

fracturing a first portion of the well after the first ball has dropped through the hole and before the second ball has dropped through the hole or the different hole; and fracturing a second portion of the well after the second ball has dropped through the hole or the different hole.

16. The method of claim 11, comprising installing the first ball and the second ball in the ball injector, wherein installing the first ball and the second ball in the ball injector includes positioning the first ball and the second ball in different chutes of the ball injector such that the first ball and the second ball bear against the sleeve.

* * * * *